United States Patent [19]

Fricke

[11] 4,165,586

[45] Aug. 28, 1979

[54] SPARK PLUG CLEANER AND METHOD

[76] Inventor: Roy A. Fricke, 1034 Ashland Ave., River Forest, Ill. 60305

[21] Appl. No.: 887,257

[22] Filed: Mar. 16, 1978

[51] Int. Cl.[2] ..... B24B 1/00; B24B 3/34

[52] U.S. Cl. ..... 51/412; 51/319; 51/424; 51/432

[58] Field of Search ..... 51/412, 424, 426, 432, 51/318-320; 241/48, 55, 97

[56] References Cited

U.S. PATENT DOCUMENTS

| | | | |
|---|---|---|---|
| 1,690,629 | 11/1928 | Fleming | 51/412 |
| 3,034,262 | 5/1962 | Pawlson | 51/424 |
| 3,567,141 | 3/1971 | Zbraniborski | 241/55 X |
| 3,868,790 | 3/1975 | Fricke | 51/412 |
| 4,028,851 | 6/1977 | Fricke | 51/412 |

FOREIGN PATENT DOCUMENTS

| | | | |
|---|---|---|---|
| 751613 | 1/1967 | Canada | 51/432 |
| 253910 | 2/1912 | Fed. Rep. of Germany | 51/426 |

*Primary Examiner*—Gary L. Smith

*Attorney, Agent, or Firm*—Emrich, Root, O'Keeffe & Lee

[57] ABSTRACT

The invention provides a spark plug cleaner operating to break up fouling carbon deposit by blasting the fouled surfaces of a spark plug, with a blasting abrasive such as granular tungsten carbide, zirconium or aluminum oxide of 36 to 46 grain size to break up the encrustation of carbon deposit on those surfaces of the plug which are exposed to combustion, and in particular, to remove the carbon from the surface of the insulator of the plug which is exposed to fractional combustion of fuel and lubricating oil. The invention performs this service by producing impingement of abrasive particles comprising a granular metal carbide, such as tungsten carbide, upon the fouled surfaces.

The invention may be embodied in a spark plug cleaner which will treat only a single spark plug at one cleaning operation or it may be embodied in a plug cleaning operation performed upon a plurality of plugs simultaneously, in a single spark plug cleaner.

6 Claims, 5 Drawing Figures

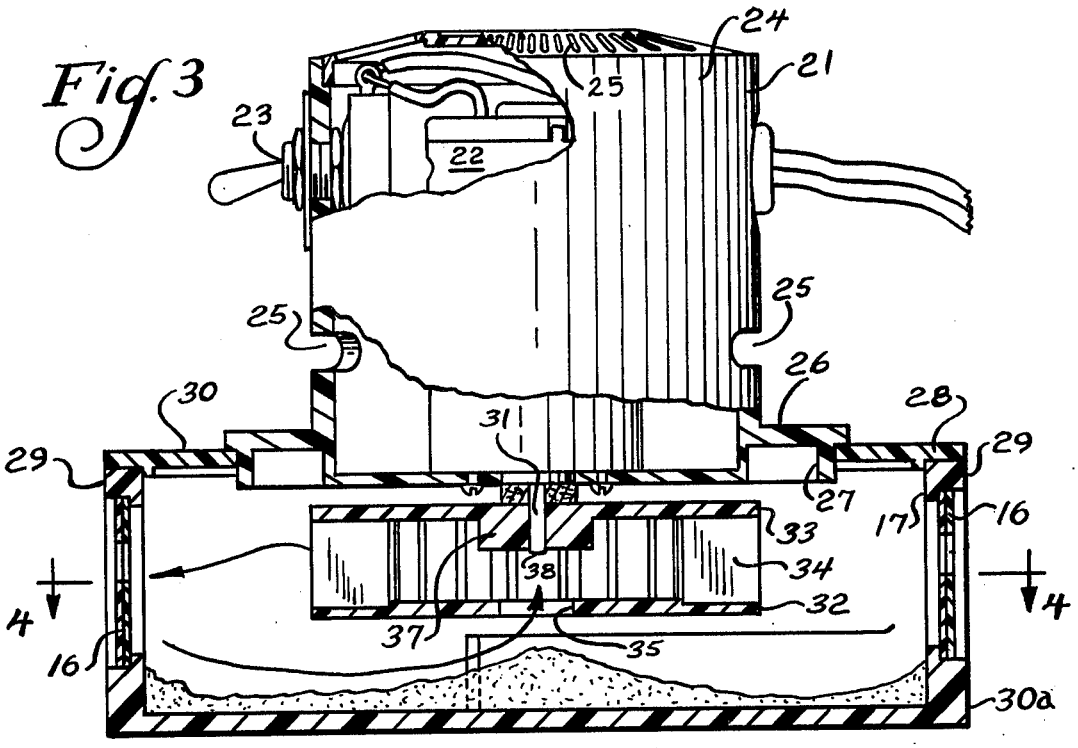
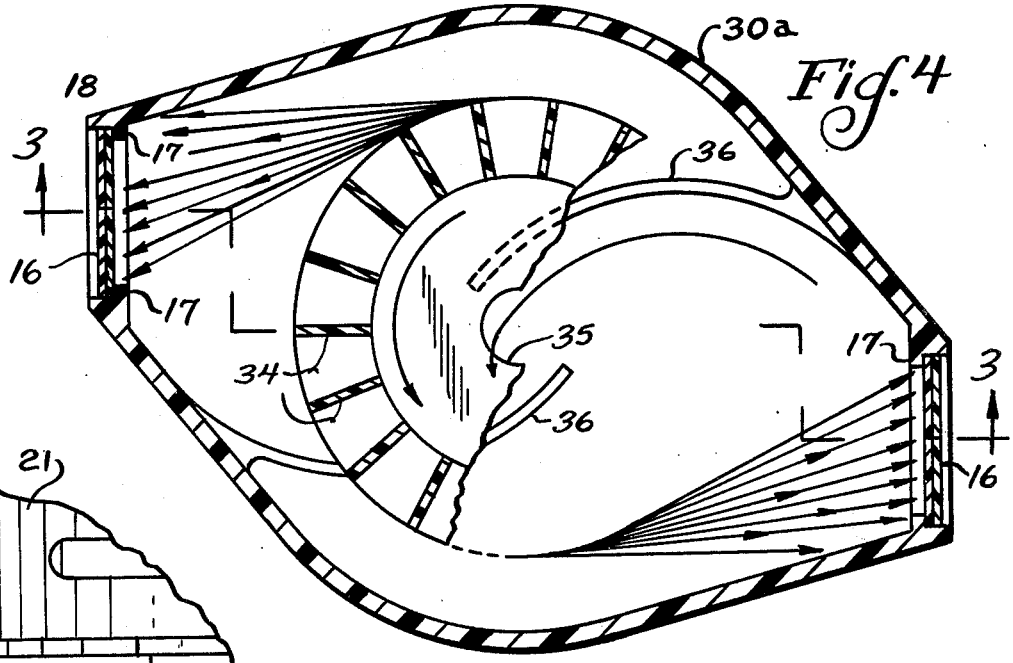
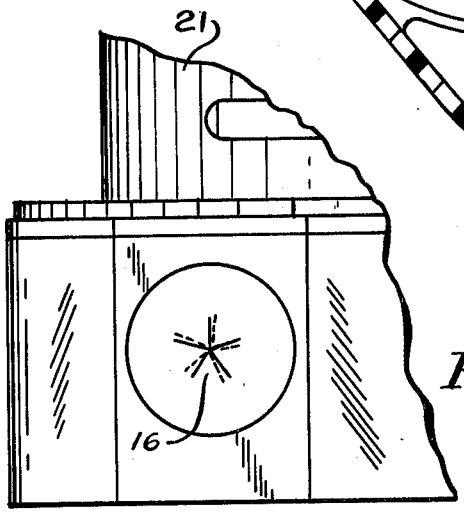
Fig. 5

SPARK PLUG CLEANER AND METHOD

BRIEF SUMMARY OF THE INVENTION

The invention, in its preferred form, comprises a casing enclosing a motor driven rotatable centrifugal blower mounted for rotation on a vertical axis with a stationary vane for establishing the direction of an air current which, driven by a high speed impeller, cooperates with a baffle or curved vane to move the particulate from a lower level which, in the preferred embodiment, may be the bottom of the casing which provides first an enclosure in which a rotary blower-impeller operates, in conjunction with a curved guiding vane to lift the particulate by causing the circulation of air within the casing to move a thin stream of particulate upwardly on a spiral or incline surface of a directing vane or baffle to deliver the particulate through the intake opening or eye at the central part of a closed type of rotary blower impeller. The impeller operates with its central plane of air and particulate discharge in horizontal register with the longitudinal axis of the spark plug, which is held in an elastic self-sealing holder, mounted in the wall of the housing or enclosure of the device.

The particulate is given two distinctly different activities by the single rotating impeller which, in one part of the cycle of operations, involves striking the grains or crystals of particulate by the impeller blades to give the particulate grains or particles a high linear velocity, and thereafter collecting the particulate by the aid of circulating air and gravity, and then lifting the same back into the high speed, high energy stage by moving the particulate up an incline by means of said impeller-induced air current. The high speed (26,000 rpm) rotor impeller furnishes the energy which is required to perform these two different actions of the particulate.

The inclined plane along which the particulate is lifted may be either the surface of a solid permanent barrier-like vane or it may be at least in part an accumulation of particulate dropped out of the circulating movement of particulate driven by the force of the air current produced by the moving impeller-like a snow drift.

BRIEF DESCRIPTION OF THE DRAWINGS

In the drawings.

FIG. 1 is a vertical section taken on the line 1—1 of FIG. 2;

FIG. 2 is a horizontal section through the device of the invention shown in FIG. 1 taken on the line 2—2 of FIG. 1;

FIG. 3 is a vertical section of a duplex spark plug cleaner taken on the line 3—3 of FIG. 4;

FIG. 4 is a horizontal section taken on the line 4—4 of FIG. 3; and

FIG. 5 is a fragmentary front elevational view illustrating the elastic duplex split diaphragm in front elevation as view from the left side of FIG. 3.

DETAILED DESCRIPTION OF THE DRAWINGS

Figure 1:
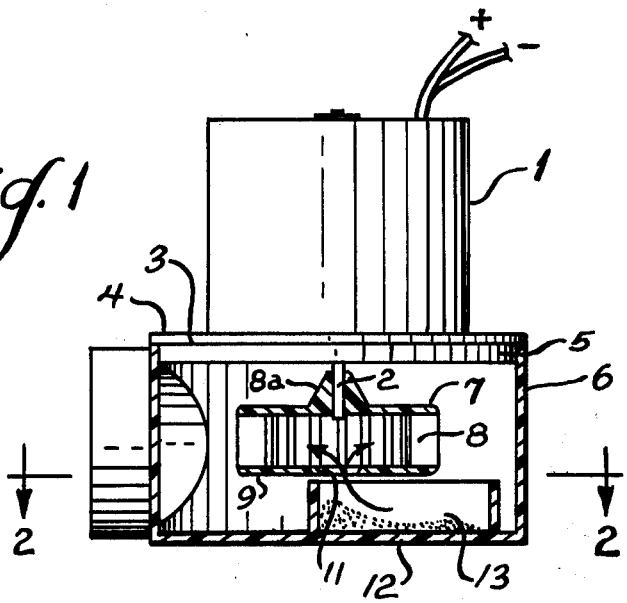
FIGS. 1 and 2 illustrate a spark plug cleaner of the present invention for operating upon a single plug at a time.
Figure 2:
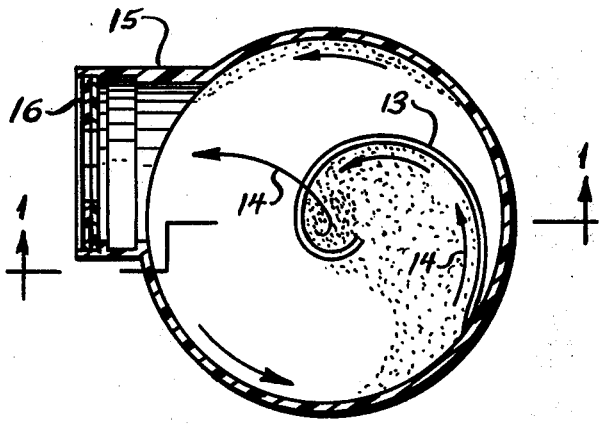

Referring now to FIGS. 1 and 2 of the drawings, a high speed electric motor 1 may be driven by the battery current of an automobile at a speed of from 10,000–15,000 RPM, or as high as 26,000 RPM for a small diameter blower. The motor shaft 2 projects down through the frictionally held cover plate 3 which plate is circular and is flanged as illustrated at 4 to hold the cylindrical extension 5 frictionally in the upper end of the cylindrical housing wall 6. The impeller is a closed impeller having the upper or inner plate 7 formed as a solid circular plate carrying the hub 8*a* attached to the motor shaft 2 for rotation on a vertical axis. The impeller has a lower annular plate 9 which is connected with the upper circular plate or disc 7 by a series of vertical vanes 8 joined at their lower ends by the plate 9 which has the central intake aperture 11 for drawing air (with particulate) into the center of the impeller for its subsequent tangential discharge.

A vertical space is provided between the lower annular intake plate 9 of the impeller and the bottom wall 12 of the impeller casing 6. In the space between the lower impeller disc 9 and the bottom wall 12 there is provided a stationary spiral or involute shaped guiding vane 13 comprising a strip of plastic insulating material which material is also employed in the construction of the cup-shaped housing 6 and the impeller 7.

The vane 13 extends from the inner periphery of the cylindrical shell casing 6 starting about 120 degrees beyond the discharge connection and coiling toward the center of the shell on a decreasing radius to provide an involute shape of stationary baffle of a height adequate to retain a suitable charge of particulate, adequate to fill up the inner end of the coiled vane 13 and deliver additional particulate vertically up through the central opening 11 into the interior of the impeller 7. The direction of rotation of the impeller in the embodiment illustrated in FIGS. 1 and 2 is counterclockwise as indicated by the arrow 14 on FIG. 2. The direction of rotation of the impeller in the embodiment illustrated in FIGS. 1 and 2 is counterclockwise whereby the rotation of the impeller tends to drive the air and particulate in a counterclockwise direction (in FIG. 2) to accumulate the particulate at the central part of the vane 13 in register with the opening 11 through the center of the lower wall of the impeller, and carry the collected particulate out through the vanes of the impeller.

The discharge of particulate up through the impeller and substantially tangentially out of the periphery of the same, as indicated by the arrow 14 in FIG. 2, is directed out through the integral cylindrical short discharge tube 15 in the outer end of which there is mounted, and peripherally held, a radially split, two ply, overlapping elastic diaphragm 16 similar to that which is shown in face view in FIG. 5. The elastic double diaphragm or sealing disc 16 is held peripherally between an inner flange or expansible retaining ring 17 and an outer flange or expansible retaining ring 18 in a well known manner. The spark plug to be cleaned, which is not illustrated, has its electrode end which bears on its outside surface the screw threads by which it is normally mounted, is pushed from the outside through the elastic sealing discs 16 shown in FIGS. 2, 3, 4 and 5, between the inner circular flange 17 and an expansible retaining ring 18 (not shown).

The spark plug to be cleaned may be pushed endwise through the double split diaphragm 16 and retained in a substantially gas tight grip, with the electrodes exposed inside the blower casing, to the blast of particulate which is thrown by the impeller 7.

The impeller 7 drives both the gaseous medium, air, and the solid granular medium, particulate. The air is recirculated and draws with its upward inflow into the impeller, particulate which is accumulated inside the curved terminal part of vane 13 by the circular flow of air, as indicated by the arrows 14 shown on FIG. 2.

The air which is driven by the vanes of the impeller at the level of the center of the spark plug is thrown tangentially outwardly by the blades of the impeller to produce the cleaning of the electrodes. Then it is moved down and sweeps the floor of the casing throughout the remainder of its circular movement. Thereupon it is sucked up into the central inlet opening in the lower side plate of the impeller. The spiral baffle or vane 13 which is mounted on the inside bottom of the cup-shaped housing 6, retards circular rotary motion of both the air and the particulate to the extent of compelling both the circulating air and the particulate to move radially inwardly. The air being light rises faster than the particulate and enters the central inlet opening in the lower plate of the impeller dragging the particulate with it into the eye of the impeller where it contacts the blades of the impeller and is violently thrown against the spark plug electrodes and the insulator, to chip off the carbon deposit.

The air current with the particulate and the carbon deposit drops down from the face of the spark plug and recirculates as the impeller continues to exercise its suction at its inlet port 11 and its centrifugal blowing effect about its entire perimeter. This blowing effect tends to pile up particulate in front of the involute shaped baffle 13 and at the same time suck up air toward the downwardly facing inlet 11 in the lower side plate of the impeller. The particulate tends to form an inclined surface in front of the end of the vane or baffle 13 to form its own flow channel. The surface chipping and scouring effect of the blast is continuous until the motor is stopped.

The embodiment of the invention shown in FIGS. 3, 4 and 5 is constructed to operate upon two spark plugs simultaneously. This does not exhaust the possibilities of treating a plurality simultaneously, since within the teachings of the present disclosure a spark plug cleaner with one, two or more spark plug holders may be constructed so that the plugs they hold may be treated simultaneously.

The embodiment of FIGS. 3, 4 and 5 illustrates how duplicate parts permit the cleaning of two or more spark plugs simultaneously. Spark plug cleaners for three or more plugs may be similarly constructed.

In FIGS. 3, 4 and 5 motor housing 21 contains a high speed motor 22 which will operate at speeds as high as 15,000 to 26,000 RPM. The motor is held along with the switch 23 in a cylindrical shell 24 with suitable provision for cooling the same through an air inlet 25 and multiple discharge ports 26 at the upper end of the shell or casing 21. The motor is of the high speed series type D.C. operating at a speed in the range of 15,000 to 26,000 RPM.

The motor has a shell which has ducts 25 for cooling the same and a switch 23 for switching off and on the battery current to the motor. The motor housing 21 comprises an annular horizontal flange 26 which carries a cylindrical depending flange 27 that fits into a circular opening in the upper plate or cover member 28 of the box-like blower housing 29. The horizontal plate 30 contains a central opening for receiving the flange 27 of the motor shell 21. Cooling ducts 25 for the motor are provided since the same is operated on high energy.

The lower box-like shell **30*a* has its open upper end closed by the plate 30 which bears the driving motor and its connected parts. The horizontal flange 26 has a depending flange 27 which fits in an opening in the plate 28**.

In this embodiment provision is made for treating two spark plugs to be cleaned simultaneously. The shell **30*a* has an opening in the top plate 30 to receive the cylindrical flange 27 of the supporting plate 28 which is integral with the shell of the motor. The shaft 31 of the motor projects down into the central part of the impeller casing 29 with the lower disc 32 of the closed impeller 30 and the upper disc 33 of the same are joined by the radial impeller vanes 34. The lower disc 32 has a central suction inlet opening 35. The upper disc 33 comprises a central hub 37 which grips the lower end of the driving motor shaft 38**.

Radial vanes 34 are carried between the plates 32 and 33. The lower plate 32 contains the suction inlet opening 35 centrally of the housing 30.

The operation of the embodiment shown in FIGS. 3, 4 and 5 is substantially the same as that of the embodiment shown in FIGS. 1 and 2 with the exception that with the two collecting vanes 36—36 in a casing 30, the impeller 34, which serves both of these vanes, carries the load of circulating a particulate laden stream of air out of the periphery of the impeller into engagement with the spark plug terminals and is returned to the central inlet opening of the impeller at 35. This comprises substantial correspondence to the parts of the device of FIGS. 1 and 2.

The two spark plug holders 16—16 are duplicates, each holding its individual plug and receiving its individual abrasive discharge through the rotation of the impeller 34 and the action of the vanes 36—36 upon the air currents which are produced by movement of the impeller. The two collecting vanes 36—36 operate more or less independently but both deliver the particulate which they collect by the currents of air which they set up to drive the particulate laden blast of air against the spark plug terminals exposed inwardly to said blast by the elastic split holding and sealing means 16—16, which is a substantial duplicate of the parts of FIG. 1 for each end of FIG. 4.

It will be obvious to those skilled in the art that this principle of utilizing the air blast internally to recirculate the air and cause it, in each cycle of recirculation, to pick up particulate, impart to it high velocity, deliver it against the spark plug terminals to clean the same, drop the released carbon and recirculate the air and particulate to go through the same cycle, so long as the motor is energized.

The structure of the spark plug holder is such that a plug may be entered or withdrawn without opening the inside of the casing to the point of allowing escape of the particulate.

The invention may be applied to spark plug cleaners of greater capacity.

If a spark plug cleaner design for treating a greater number of spark plugs simultaneously is desired, it may be produced by disposing a larger number of plug holders in a casing of greater diameter and a greater number of plug holders and corresponding number of spiral directing vanes 36.

What is claimed is:

1. A spark plug cleaner for directing particulate against the electrodes of a spark plug, including in combination:

a cup-shaped blower casing having a bottom wall and sidewall therearound, a self-sealing spark plug holder mounted in said sidewall, said holder adapted to receive and mount a spark plug to present the electrodes of the spark plug to the interior of said blower casing, a cover plate mounted to said casing, a motor mounted on said cover plate, said motor having a vertical drive shaft extending below said cover plate, a closed impeller mounted to said vertical drive shaft, said closed impeller having a bottom plate with a central inlet opening and having blades adapted to engage and project particulate into contact with the exposed electrodes of the spark plug held in said holder, and a spiral vane mounted to said sidewall and extending inwardly in a decreasing radius along the bottom wall of said blower casing to the center of said blower casing to a position below said central inlet opening of said closed impeller, such that upon rotation of said impeller, said impeller directs particulate particles and air along said spiral vane and into said closed impeller to be directed into contact with the electrode of the spark plug to clean the same.

2. The spark plug cleaner in accordance with claim 1 wherein said spiral vane is of uniform height along its entire length thereof.

3. The spark plug cleaner in accordance with claim 2 wherein said end of said spiral vane opposite to the end mounted to said sidewall substantially encircles said center of said blower casing.

4. A spark plug cleaner for directing particulate against the electrodes of a spark plug including in combination:

a blower casing having a bottom wall and sidewall therearound, first and second self-sealing spark plug holders mouned in said sidewall, each of said holders adapted to receive and mount a spark plug to present the electrodes of the spark plug to the interior of said blower casing, a cover plate mounted to said casing, a motor mounted on said cover plate, said motor having a vertical drive shaft extending below said cover plate, a closed impeller mounted to said vertical drive shaft, said closed impeller having a bottom plate with a central inlet opening and having blades adapted to engage and project particulate into contact with the exposed electrodes of the spark plug held in said first and said second holders, and first and second spiral vanes each mounted to said sidewall and extending inwardly in an arc an equal distance from the center line of each of said first and said second holders along the bottom wall of said blower casing to a position below said central inlet opening of said closed impeller to an overlapping position, such that upon rotation of said impeller, said impeller directs particulate particles and air along each of said first and second spiral vanes and into said closed impeller to be directed into contact with the electrodes of the spark plugs to clean the same.

5. The spark plug cleaner in accordance with claim 4 wherein each of said first and second spiral vanes are of uniform height along their entire length thereof.

6. A method of cleaning the electrodes of a spark plug, including the steps of:

producing a circulating flow of air and particulate length a closed impeller, directing said air and particulate against the electrodes of a spark plug, dropping said air and spent particulate to a level lower than said closed impeller, forming particulate into a spiral pile of increasing height which terminates at a point below said closed impeller, and circulating said air and particulate along said spiral pile of particulate and into the interior of said closed impeller so that said air and said particulate may be directed against the electrodes of a spark plug.

* * * * *